United States Patent [19]

Green

[11] Patent Number: 4,558,538

[45] Date of Patent: Dec. 17, 1985

[54] SLIDING SLEEVE DRUM SANDER

[76] Inventor: Laurence Green, Box 156, Gildford, Mont. 59525

[21] Appl. No.: 469,635

[22] Filed: Feb. 25, 1983

Related U.S. Application Data

[63] Continuation-in-part of Ser. No. 352,957, Feb. 26, 1982, abandoned.

[51] Int. Cl.[4] ..... B24B 7/08

[52] U.S. Cl. ..... 51/72 R; 51/378; 144/218

[58] Field of Search ..... 51/34 R, 34 C, 34 H, 51/72 R, 168, 389, 384, 382, 372, 369, 367, 358, 166 TS, 378; 403/366, 290, 342, 371; 279/10 C, 56, 42, 48; 144/218, 134 A

[56] References Cited

U.S. PATENT DOCUMENTS

| | | | |
|---|---|---|---|
| 5,915 | 6/1874 | Hapgood | 51/34 H |
| 283,832 | 8/1883 | Thayer et al. | 51/206 R |
| 923,041 | 5/1909 | Garretson | 279/42 |
| 1,162,970 | 12/1915 | Binford | 51/168 |
| 1,277,377 | 3/1918 | Carter | 51/34 H |
| 1,701,815 | 2/1929 | Maddox | 51/143 |
| 2,170,627 | 8/1939 | Berryman | 51/134.5 R |
| 2,766,471 | 10/1956 | McKenzie | 403/290 |
| 2,865,140 | 12/1955 | Shumway | 51/34 R |
| 2,895,267 | 7/1959 | Kozacka | 51/378 |
| 3,611,643 | 12/1968 | Crane | 51/76 R |

*Primary Examiner*—Frederick R. Schmidt
*Assistant Examiner*—Robert A. Rose
*Attorney, Agent, or Firm*—Wells, St. John & Roberts

[57] ABSTRACT

Disclosed is a drum sander having a frame with a workpiece support surface thereon. A motor is mounted on the upper end of the frame over the workpiece support surface. An arbor extends between the motor and a supporting thrust bearing to intersect the workpiece support surface. The arbor is preferably provided with a sleeve which is slidable along the arbor so as to expose different portions of the abrasive surface of the sleeve. The abrasive surface such as sandpaper is preferably adhered to the outside cylindrical surface of the sleeve. Securement mechanisms are used to securely fix the axial position of the sleeve along the arbor. The drum sander can alternatively be fitted with a file which rests within an insert mounted in the workpiece support surface in lieu of the arbor and sleeve arrangement.

9 Claims, 5 Drawing Figures

FIG 3
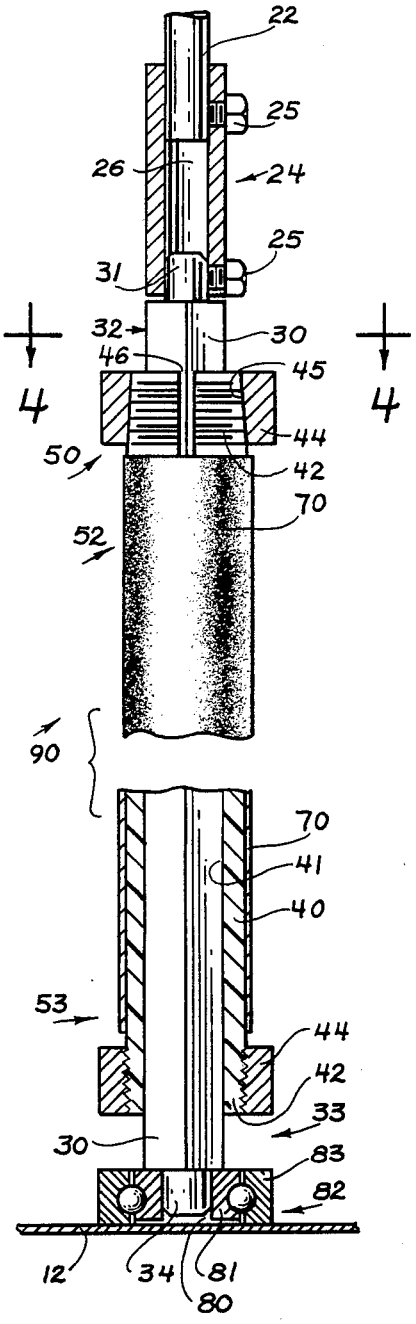
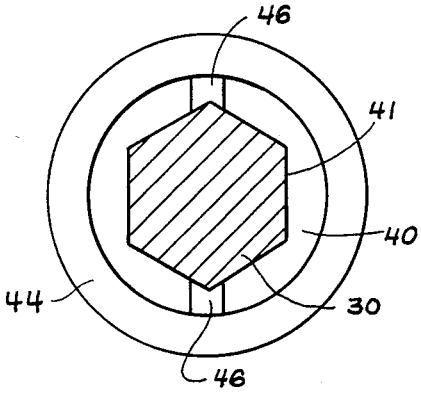
FIG 4
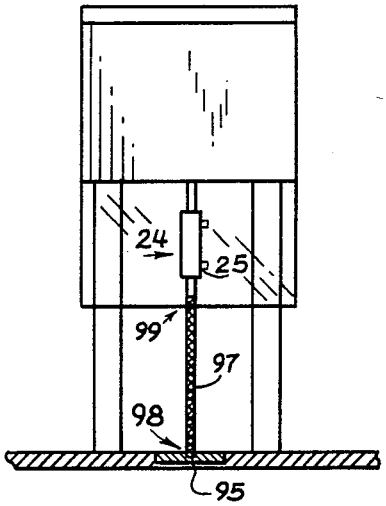
FIG 5

SLIDING SLEEVE DRUM SANDER

CROSS REFERENCE TO RELATED APPLICATION

This application is a continuation-in-part of U.S. Application Ser. No. 352,957, filed Feb. 26, 1982, now abandoned.

TECHNICAL FIELD

The technical field of this invention is drum sanders.

BACKGROUND OF THE INVENTION

A drum sander is used primarily in the woodworking arts to abrade edge surfaces of a workpiece. The abrasive drum is cylindrical and usually oriented perpendicularly to the flat workpiece support surface.

Various multipurpose power tools have been used as drum sanders. For example, drill passes are often used with a sanding drum mounted in one end of the drill chuck. Sanding drums can also be mounted to the arbors of radial arm saws and to similar power driven equipment.

Drum or spindle sanders have also been produced as single purpose power tools. The abrasive drums are typically mounted at their bottom ends to motor drives which are positioned beneath workpiece support surfaces. The drums usually project up through openings in the support surfaces. Some prior art drum sanders hold the drums axially stationary while others include some mechanism for axially reciprocating the drum as it is rotated.

The prior art drum sanders typically have interchangeable drums which are supported by bearings at only one end. Supporting the drum at only one end allows the drum to flex in the transverse directions thereby making precision work more difficult. Supporting at one end also creates greater loading on the bearings supporting the drum sander shaft because of the overhung bearing configuration. This leads to faster failure of the sander bearings.

A typical drum sanding machine is illustrated in the U.S. Pat. No. 1,277,377 to R. L. Carter. The sanding drum is mounted on an arbor that oscillates axially. The Carter sander has a sanding drum which is only supported beneath the workpiece support surface.

The current invention is directed to solving the problems discussed above and obviating other problems by using the structure disclosed below.

BRIEF DESCRIPTION OF THE DRAWINGS

A preferred and alternate embodiment of this invention is illustrated in the accompanying drawings, in which:

FIG. 3 is an enlarged view of the drum sander arbor and sliding sleeve used in the drum sander of FIG. 1. Portions have been broken away and shown in section of greater illustrative value;

FIG. 4 is a cross-sectional view taken along line 4—4 of FIG. 3; and FIG. 5 is a partial front elevational view of the drum sander of FIG. 1 with an alternative cylindrical file installed thereon in lieu of the arbor and sliding sleeve drum sander arrangement.

DETAILED DESCRIPTION OF THE PREFERRED EMBODIMENTS

In compliance with the constitutional purpose of the Patent Laws "to promote the progress of science and useful arts" (Article 1, Section 8), applicant submits the following disclosure of the invention.

Figure 1:
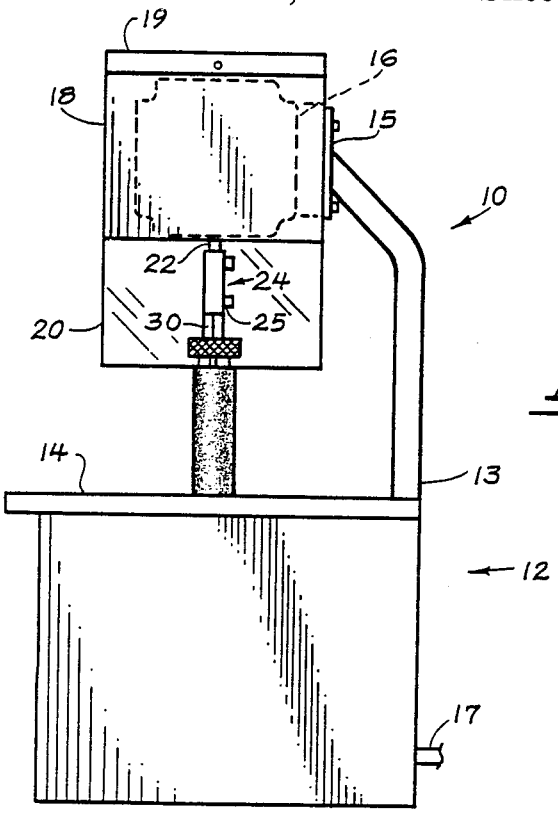
FIG. 1 is a side elevational view of a preferred embodiment of the drum sander of this invention.

A drum sander according to this invention is shown in FIG. 1. The sander is generally referred to by the reference numeral 10. Sander 10 has a frame 12 which includes a motor support arm 13 which extends upwardly above a workpiece support surface 14.

Motor support arm 13 includes a mounting plate 15. A motor means 16 is rigidly attached to the motor support arm at mounting plate 15. Motor means 16 is preferably an electric AC motor. When motor means 16 is an electric motor, electricity is provided through an electrical cord 17 which preferably enters the sander frame 12 at a low position and is run upwardly through motor support arm 13 to motor means 16.

Motor means 16 is preferably provided with a cowling 18 and cowling top 19 which helps to reduce infiltration of sawdust into the motor. Extending downwardly from cowling 18 is a safety shield 20 which is preferably made of transparent or translucent material.

Motor means 16 has a motor shaft 22 which extends from the end of motor means 16 toward the workpiece support surface 14. An arbor 30 is connected to motor means shaft 22 using a connection means 24. Connection means or coupling 24 preferably has an interior cavity 26 which receives the ends of motor shaft 22 and arbor 30 therein. Set screws 25 are preferably used to securely hold the connection means 24 to motor shaft 22 and arbor 30.

Arbor 30 preferably has an outside cross-sectional shape which is noncircular as most clearly shown in FIG. 4. In FIG. 4 arbor 30 is shown with an approximately hexagonal exterior cross-sectional shape. Alternatively arbor 30 could be square, pentagonal, elliptical or any other noncircular shape which would prevent the arbor from tending to rotate with respect to sleeve 40. Sleeve 40 is provided with an interior cavity 41 which is appropriately shaped to receive arbor 30. Interior cavity 41 is large enough to allow the sleeve 40 to easily slide axially along arbor 30 thereby allowing the sleeve 40 to be positioned at various points along arbor 30.

Slidable sleeve 40 is fixed at a particular axial position along arbor 30 using a releasable securement means. Many securement means are possible, one exemplary embodiment being that shown in FIGS. 2, 3 and 4. Releasable securement means 50 comprises a threaded region 42 which is preferably tapered. A nut means 44 is provided with interior threads 45 which are appropriately sized to engage with threaded region 42 of sliding sleeve 40. Securement means 50 also includes at least one slot means 46 which is cut through the peripheral wall of the threaded region 42 of sleeve 40. Slot means 46 allows the threaded region 42 to be compressed inwardly so as to contract against the arbor 30 to securely hold the sliding sleeve 40 at a fixed axial position along arbor 30. Threaded region 42 contracts about arbor 30 when nut means 44 is threaded into threaded region 42 thereby causing the tapered threads 45 of nut means 44 to compress the threaded region 42 against arbor 30.

Sliding sleeve 40 is preferably provided with an abrasive layer 70 which can advantageously be a piece of ordinary sand paper which has been cut to size and adhered to the outside cylindrical surface of sliding sleeve 40. Alternatively, sleeve 40 could be produced with an abrasive layer sprayed coated onto the outside diameter or sleeve 40 could otherwise be provided with an abrasive surface.

The first end 32 of arbor 30 is preferably provided with a cylindrical end 31 which fits into cavity 26 of coupling 24. The second end 33 of arbor 30 is also provided with a similar end 34 which is most clearly shown in FIG. 3. End 34 preferably fits within aperture 80 in the inner race 81 of thrust bearing 82. Ends 31 and 34 are preferably sized the same so that arbor 30 can be inverted with the ends changing their respective positions.

The outer race 88 of thrust bearing 82 is preferably rigidly connected to the lower panel of frame 12 thereby providing rigid support for the second end 33 or arbor 30. The first end 32 of arbor 30 is rigidly supported by the bearings of motor means 16 (not shown).

The preferred embodiment shown in FIGS. 1 through 4 is used by first adhering a piece of sandpaper 70 to the outside of sleeve 40 using a suitable adhesive which are well-known and commonly available. Sleeve 40 is then threaded onto arbor 30 before the arbor is mounted in frame 12. Nut means 44 are preferably knurled nuts which are also threaded over the arbor 30 and threaded onto threaded regions 42 at first and second ends 53 and 53 of sleeve 40.

Figure 2:
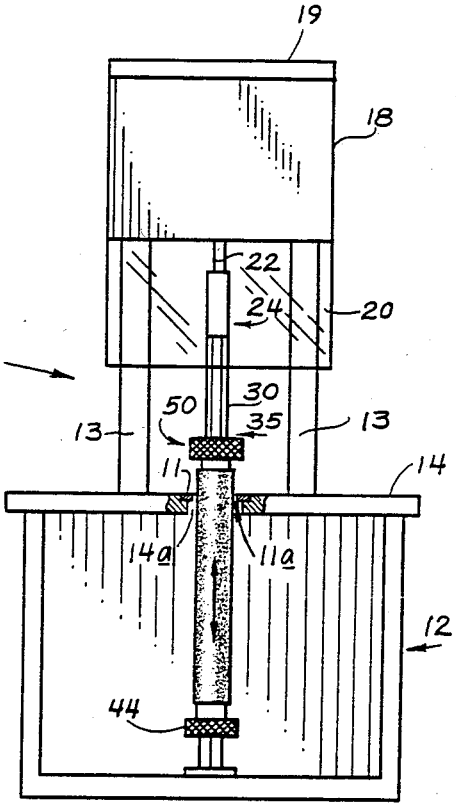
FIG. 2 is a front elevational view of the drum sander shown in FIG. 1.

The rotating assembly 90 formed by sleeve 40, securement means 50, and arbor 30 is then ready for installation within the frame (FIG. 2). Installation is accomplished by first removing an annular shaped removable insert 11 which forms a part of workpiece support surface 14. Removal of insert 11 allows the rotating assembly 90 to be threaded upwardly through aperture **14*a* in the workpiece support surface. Rotating assembly 90 can also be inserted through insert 11 and the insert is positioned within aperture 14*a* to cover the area around the rotating assembly. In some cases a very close fit between insert 11 and the sleeve 40 may require that nut means 44 be removed so as to allow the rotating assembly to be inserted within the aperture 11*a* of insert 11. Nut means 44 is then reinstalled over the threaded portion 42 of sleeve 40**.

The rotating assembly 90 is securely positioned within the drum sander by first installing the end 34 of arbor 30 within aperture 80 of thrust bearing 82. Connection or coupling means 24 can then be installed over the ends of motor shaft 22 and end 31 of arbor 30 according to well-known installation techniques. Coupling means 24 is securely held to arbor 30 and motor shaft 22 using set screws 25.

Sliding sleeve 40 is then positioned upon arbor 30 by first unscrewing nut means 44 at both first and second ends 52 and 53 of sleeve 40. Sleeve 40 can then be positioned axially along arbor 30 at any point within the slidable region which is defined by the hexagonal shape shown in FIGS. 2 and 3. Once the desired position is selected, the nut means 44 are tightened at both the first and second ends thereby causing the threaded region 42 of sleeve 40 to contract against arbor 30 securely holding the sleeve at a particular axial position along arbor 30.

During operation, the sandpaper or other abrasive surface 70 on sleeve 40 will become worn or loaded with abraded material just above the workpiece support surface 14. When the abrasive surface 70 is worn out or loaded, it is desirable to adjust the position of sleeve 40 so that a new portion of abrasive surface 70 is positioned at the desired region above workpiece support surface 14. Adjustment of the axial position of sleeve 40 can be carried out as described above at any time in order to expose fresh abrasive.

It is preferable to construct the arbor 30 with a slidable region 35 which is approximately one and one-half times longer than the sleeve 40. This allows the length of the arbor and the height of the sander to be minimized while allowing the full height of the abrasive layer 70 to be used. The full height of abrasive layer 70 can be used by removing the rotating assembly and reversing the ends 31 and 34 so that the first end 32 of the arbor which was previously positioned within the connection means 24, is now positioned within the aperture 80 and thrust bearing 82. Similarly, the end 34 of arbor 30 is then installed within the cavity 26 of connection means 24 and secured therein using set screw 25. In some cases, it may be desirable to have an arbor which is twice as long as the sleeve 40 thereby allowing the sleeve to be positioned upwardly and downwardly upon the arbor to use the entire abrasive surface 70 without inverting the rotating assembly 90.

FIG. 5 shows the drum sander fitted with an alternative abrasive means. Rotating assembly 90 has been removed and a file bearing insert 95 has been installed within opening or aperture **14*a* of workpiece support surface 14. File bearing insert 95 has a bearing means therein which allows the second end 98 of file 97 to be rotatably supported therein. File 97 is also supported at its upper first end 99 within cavity 26 of connection means 24 and secured therein using set screw 25 in a fashion similar to the arbor 30. The motor means 16 is then used to rotate file 97 and a workpiece can be brought up against the rotating outer surface of file 97** to abrade material therefrom.

The invention can be manufactured according to well-known manufacturing techniques which will be readily apparent to one of ordinary skilled in the art.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A power driven drum sander, comprising:

a frame having a workpiece support surface forming a part thereof;

motor means rigidly and stationarily attached to the frame and having a rotational axis which intersects with the workpiece support surface;

an elongated arbor having a first end and a second end; said first end of the arbor being connected to the motor means and adapted for rotation therewith; said second end of the arbor being rotatably supported by the frame; said arbor having a slidable regin upon exterior surfaces thereof, said slidable region having a noncircular cross-sectional shape;

a cylindrical sleeve positioned coaxially upon the arbor along said slidable region;

releasable adjustable securement means for allowing the sleeve to be adjustably positioned axially along the arbor and for securely holding the sleeve at a fixed axial position upon the arbor; said securement means having a tapered threaded region formed upon an end of said sleeve, nut means threadably received upon threaded region, and at least one slot means cutting through the peripheral wall of the threaded region to allow the threaded region of the sleeve to contract against the arbor as the nut means is tightened onto the tapered threaded region of the sleeve; and abrasive material secured to the cylindrical sleeve about its outer cylindrical surface.

2. The drum sander of claim 1 wherein the arbor extends through an aperture in the workpiece support surface.

3. The drum sander of claim 1 wherein the arbor extends through an aperture in the workpiece support surface at an angle perpendicular thereto.

4. The drum sander of claim 1 wherein said slidable region includes a hexagonal exterior cross-sectional shape to prevent the sleeve from turning upon the arbor.

5. The drum sander of claim 1 wherein said slidable region includes a square exterior cross-sectional shape to prevent the sleeve from turning upon the arbor.

6. The drum sander of claim 1 further comprising a coupling means for connecting the arbor to the motor means.

7. The drum sander of claim 1 wherein said sleeve is approximately one half the length of the arbor to allow the sleeve to be adjustably positioned upon the arbor to allow use of approximately the full height of the sleeve.

8. The drum sander of claim 1 wherein the arbor includes a slidable region which is approximately one and one half times as long as the sleeve, and said workpiece support surface is approximately perpendicular to the arbor at near the midpoint of the slidable region.

9. The drum sander of claim 1 wherein the workpiece support surface is provided with a removable annularly shaped insert which is positioned adjacent to the arbor and sleeve.

* * * * *